US005380168A

United States Patent [19]

Kimura et al.

[11] Patent Number: 5,380,168

[45] Date of Patent: Jan. 10, 1995

[54] AXIAL MULTI-PISTON COMPRESSOR HAVING ROTARY VALVE FOR ALLOWING RESIDUAL PART OF COMPRESSED FLUID TO ESCAPE

[75] Inventors: Kazuya Kimura; Hideki Mizutani; Shigeyuki Hidaka; Toru Takeichi, all of Kariya, Japan

[73] Assignee: Kabushiki Kaisha Toyoda Jidoshokki Seisakusho, Aichi, Japan

[21] Appl. No.: 185,710

[22] Filed: Jan. 24, 1994

[30] Foreign Application Priority Data

Jan. 25, 1993 [JP] Japan ..... 5-010165

[51] Int. Cl.[6] ..... F04B 1/12

[52] U.S. Cl. ..... 417/269; 417/271; 91/499; 137/625.11

[58] Field of Search ..... 417/222.1, 222.2, 216, 417/218, 269, 271; 91/499, 503; 137/625.21, 625.22, 625.23, 625.11

[56] References Cited

U.S. PATENT DOCUMENTS 5,232,349 8/1993 Kimura et al. ..... 417/269

*Primary Examiner*—Richard A. Bertsch
*Assistant Examiner*—Alfred Basichas
*Attorney, Agent, or Firm*—Burgess, Ryan and Wayne

[57] ABSTRACT

An axial multi-piston compressor includes a drive shaft, a cylinder block having cylinder bores formed therein and surrounding the drive shaft, and a plurality of pistons slidably received in the respective cylinder bores, wherein the pistons are successively reciprocated in the cylinder bores by a rotation of the drive shaft so that a suction stroke and a discharge stroke are alternately executed in each of the cylinder bores. During the suction stroke, a fluid is introduced into the cylinder bore concerned, and during the compression stroke, the introduced fluid is compressed and discharged from the cylinder bore concerned, such that a residual part of the compressed fluid is inevitably left in the cylinder bore concerned when the compression stroke is finished. The compressor further includes a rotary valve for allowing the residual part of the compressed fluid to escape from the cylinder bore concerned into two other cylinder bores disposed adjacent to each other and subjected to the compression stroke.

7 Claims, 6 Drawing Sheets

AXIAL MULTI-PISTON COMPRESSOR HAVING ROTARY VALVE FOR ALLOWING RESIDUAL PART OF COMPRESSED FLUID TO ESCAPE

BACKGROUND OF THE INVENTION

1) Field of the Invention

The present invention relates to an axial multi-piston compressor comprising a drive shaft, a cylinder block having cylinder bores formed therein and surrounding the drive shaft, and a plurality of pistons slidably received in the cylinder bores, respectively, wherein the pistons are successively reciprocated in the cylinder bores by a rotation of the drive shaft so that a suction stroke and a discharge stroke are alternately executed in each of the cylinder bores.

2) Description of the Related Art

Japanese Unexamined Patent Publication (Kokai) No. 59(1984)-145378 discloses a swash plate type compressor as representative of an axial multi-piston compressor, which may be incorporated in an air-conditioning system used in a vehicle such as an automobile. This swash plate type compressor comprises: front and rear cylinder blocks axially combined to form a swash plate chamber therebetween, the combined cylinder blocks having a same number of cylinder bores radially formed therein and arranged with respect to the central axis thereof, the cylinder bores of the front cylinder block being aligned and registered with the cylinder bores of the rear cylinder block, respectively, with the swash plate chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable drive shaft arranged so as to be axially extended through the front housing and the combined cylinder blocks; and a swash plate securely mounted on the drive shaft within the swash plate chamber and engaging with the double-headed pistons to cause these pistons to be reciprocated in the pairs of aligned cylinder bores, respectively, by the rotation of the swash plate.

The front and rear valve plate assemblies in particular have substantially the same construction, in that each comprises: a disc-like member having sets of a suction port and a discharge port each set being able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged-so as to open and close the corresponding discharge port of the disc-like member. Each of the front and rear valve plate assemblies is also provided with suction openings aligned with passages formed in the front or rear cylinder block, respectively, whereby the suction chambers formed by the front and rear housings are in communication with the swash plate chamber into which a fluid or refrigerant is introduced from an evaporator of an air-conditioning system, through a suitable inlet port formed in the combined cylinder blocks.

In the swash plate type compressor as mentioned above, the drive shaft is driven by the engine of a vehicle, such as an automobile, so that the swash plate is rotated within the swash plate chamber, and the rotational movement of the swash plate causes the double-headed pistons to be reciprocated in the pairs of aligned cylinder bores. When each piston is reciprocated in the aligned cylinder bores, a suction stroke is executed in one of the aligned cylinder bores and a compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

In this type compressor, the refrigerant includes a lubricating oil mist, and the movable parts of the compressor are lubricated with the oil mist during the operation. Also, the oil mist appears on the suction and discharge reed valve elements, and serves as a liquid-phase seal when each of the reed valve elements is closed.

When the compression stroke is finished in each of the cylinder bores, the corresponding discharge reed valve element is closed. At this point of time, a small part of the compressed refrigerant is inevitably left in a fine space defined between the piston head and the valve plate assembly and in the discharge port formed in the valve plate assembly, and the corresponding suction reed valve element is adhered to the valve seat thereof with the liquid-phase oil. Accordingly, just after the suction stroke is initiated, i.e., just after the corresponding head of the double-headed piston is moved from top dead center toward bottom dead center, the suction reed valve element cannot be immediately opened, i.e., the refrigerant cannot be immediately introduced from the suction chamber into the cylinder bore through the suction reed valve element, because the residual part of the compressed refrigerant has a higher pressure than that of suction chamber, and because and the adhesion force and resilient force of the suction reed valve must be overcome before the refrigerant can be introduced from the suction chamber to the cylinder bore through the suction port. Namely, at the beginning of the suction stroke, the residual part of the compressed refrigerant is merely expanded in the cylinder bore, and thus the introduction of the refrigerant from the suction chamber into the cylinder bore cannot take place until a differential between the pressures in the cylinder bore and the suction chamber exceeds a certain level.

Therefore, in the compressor as mentioned above, a practical suction volume of the refrigerant, which can be obtained during the suction stroke, is lower than a theoretical suction volume of the refrigerant due to the residual part of the compressed refrigerant, and thus it is impossible to sufficiently realize a theoretical performance from the compressor.

Japanese Unexamined Patent Publication (Kokai) No. 5(1993)-71467, corresponding to U.S. Pat. No.

5,232,349 issued on Aug. 3, 1993, discloses an axial multi-piston compressor constituted such that a theoretical suction volume of the refrigerant can be substantially obtained during the suction stroke. In this compressor, the suction reed valves are substituted for a single suction rotary valve slidably disposed in a central circular space formed in the cylinder block and joined to the drive shaft for rotation thereof. Namely, the valve plate assembly is provided with only the discharge reed valve elements and the discharge ports, and the suction reed valve elements and the suction ports are eliminated therefrom. The suction rotary valve is provided with an arcuate groove formed in a peripheral surface thereof, and the arcuate groove is in communication with the suction chamber. The suction rotary valve is further provided with a through passage extending diametrically therethrough. On the other hand, the cylinder block is provided with radial passages formed therein, and each of these radial passages is in communication with the corresponding cylinder bore at an end face thereof on which the discharge port is disposed. The inner ends of the radial passages are opened at an inner wall face of the central circular space of the cylinder block in which the suction rotary valve is slidably received.

In the compressor as disclosed in JUPP (Kokai) No. 5(1993)-71467 (U.S. Pat. No. 5,232,349), when the suction stroke is executed in each of the cylinder bores, the cylinder bore concerned is communicated with the suction chamber through the radial passage thereof and the arcuate groove of the suction rotary valve, so that the refrigerant is introduced thereinto. During the suction stroke, the communication is maintained between the cylinder bore and the suction chamber due to a given arcuate length of the arcuate groove. When the suction stroke is finished, i.e., when the piston reaches bottom dead center, the communication between the cylinder bore and the suction chamber is cut off. Then, the compression stroke is initiated, so that the piston stroke is moved from bottom dead center toward top dead center. When the compression stroke is finished, i.e., when the piston reaches top dead center, a part of the compressed refrigerant is inevitably left in a small volume of the cylinder bore defined by the piston head and the valve plate assembly, similar to the compressor as disclosed in JUPP (Kokai) NO. 59(1984)-145378. However, just after the compression stroke is finished, i.e., just after the piston is moved from top dead center toward bottom dead center, the cylinder bore concerned is communicated with the diametrically opposed cylinder bore, in which the suction stroke is just finished, through the diametrical through passage formed in the rotary valve, and thus the residual park of the compressed refrigerant escapes from the cylinder bore concerned to the diametrically opposed cylinder bore not governed by the compression stroke. Accordingly, as soon as the cylinder bore concerned is made to communicate with the suction chamber through the radial passage thereof and the arcuate groove of the rotary valve, the refrigerant is introduced from the suction chamber the cylinder bore concerned, due to the escape of the residual part of the compressed refrigerant. As a result, a practical suction volume of the refrigerant, which can be obtained during the suction stroke, is substantially equal to a theoretical suction volume of the refrigerant, and thus it is possible to substantially realize a theoretical performance from the compressor.

Nevertheless, the compressor shown in U.S. Pat. No. 5,232,349 involves a problem to be solved. In particular, the higher the running speed of the compressor, i.e., the higher the rotational speed of the rotary valve, the shorter the time of period during which the communication between the diametrically disposed cylinder bores, through the diametrical through passage formed in the rotary valve is possible. Accordingly, as the running speed of the compressor is increased, the amount of the residual refrigerant escaping from the cylinder bore concerned to the diametrically opposed cylinder bore becomes smaller, and thus the practical suction volume of the refrigerant, which can be obtained during the suction stroke, is reduced at a higher running speed of the compressor.

SUMMARY OF THE INVENTION

Therefore, an object of the present invention is to provide an axial multi-piston compressor constituted such that a residual part of the compressed fluid escapes from a cylinder bore to bring the practical suction volume of the fluid as close to a theoretical suction volume as possible even at a higher running speed of the compressor.

In accordance with the present invention, there is provided an axial multi-piston compressor comprising: a drive shaft; a cylinder block having cylinder bores formed therein and surrounding the drive shaft; a plurality of pistons slidably received in the respective cylinder bores; a conversion means for converting a rotational movement of the drive shaft into a reciprocation of each piston in the corresponding cylinder bore such that a suction stroke and a discharge stroke are alternately executed therein, during the suction stroke, a fluid being introduced into the cylinder bore concerned, and during the compression stroke, the introduced fluid being compressed and discharged from the cylinder bore concerned, such that a residual part of the compressed fluid is inevitably left in the cylinder bore concerned when the compression stroke is finished; and a valve means for allowing the residual fluid to escape from the cylinder bore concerned into two other cylinder bores disposed adjacent to each other and subjected to the compression stroke, whereby a practical suction volume of the fluid can be made close to a theoretical suction volume even during high speed running of the compressor. The residual fluid escapes from the cylinder bore concerned into the one of the two other cylinder bores which is subjected to a compression stroke prior to the other cylinder bore being subjected to a compression stroke.

The valve means may comprise a rotary valve joined to the drive shaft to be rotated together therewith and having a groove passage formed in a peripheral surface thereof, and during the rotation of the rotary valve, the communication between the cylinder bore concerned and each of the two other cylinder bores is established by the groove passage, whereby the residual part of the compressed fluid can escape from the cylinder bore concerned into each of the two other cylinder bores.

Preferably, the rotary valve is slidably disposed in a circular space defined by a part of a central passage formed in the cylinder block, and the cylinder block has radial passages formed therein and extended from the cylinder bores to the circular space of the cylinder block, respectively. The communication between the cylinder bore concerned and each of the two other cylinder bores is established by the groove passage and the radial passages thereof during the rotation of the rotary valve in the circular space of the cylinder block.

The rotary valve may include a suction passage or sector-shaped groove formed therein to introduce the fluid into each of the cylinder bores during the suction stroke, and the groove passage and the sector-shaped groove may be diametrically opposed to each other on the peripheral surface of the rotary valve. Preferably, the groove passage is arranged so as to surround the openings of the radial passages of the compression chambers subjected to the compression stroke.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
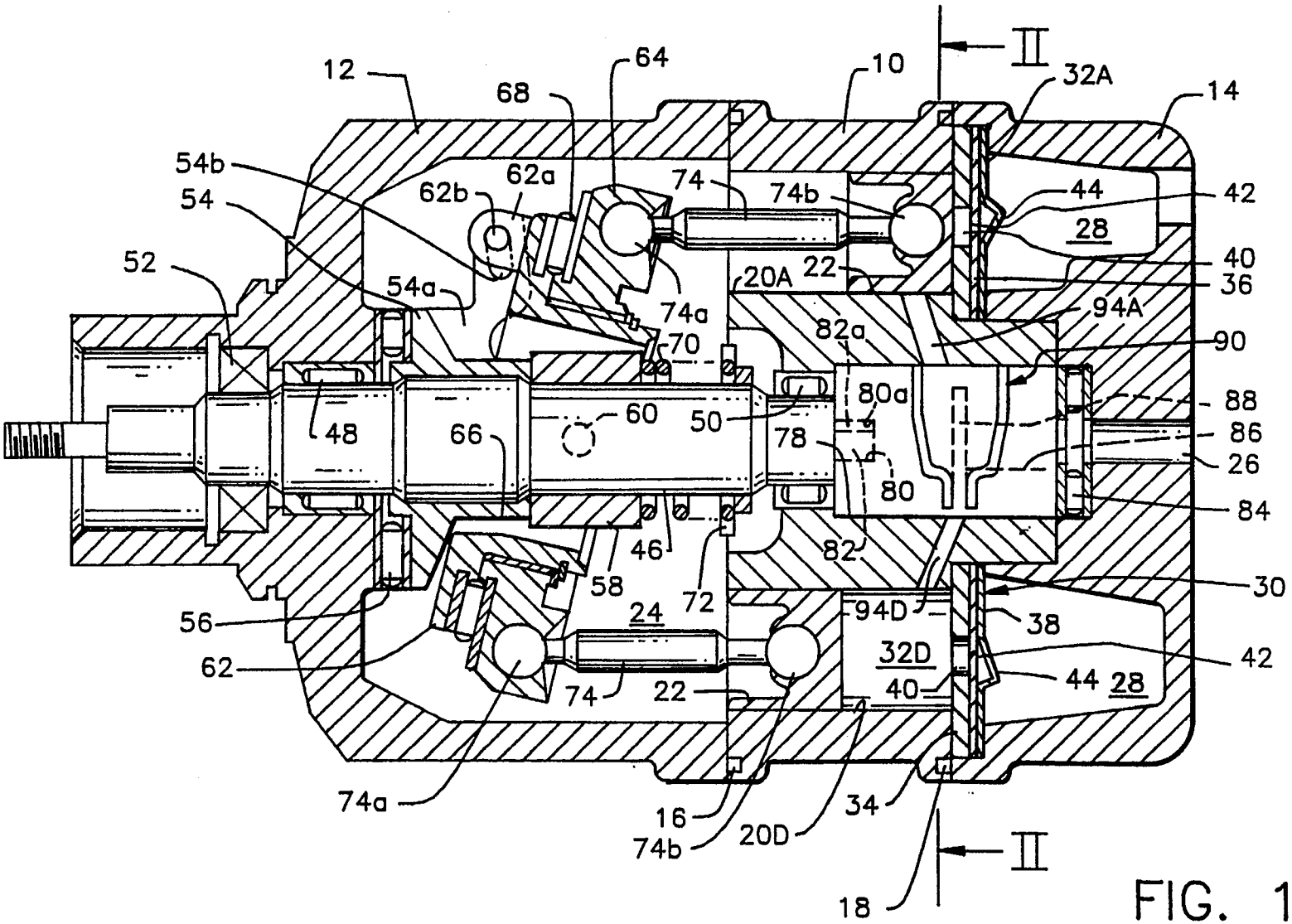
FIG. 1 is a longitudinal sectional view showing a swash plate type compressor according to the present invention.
Figure 2:
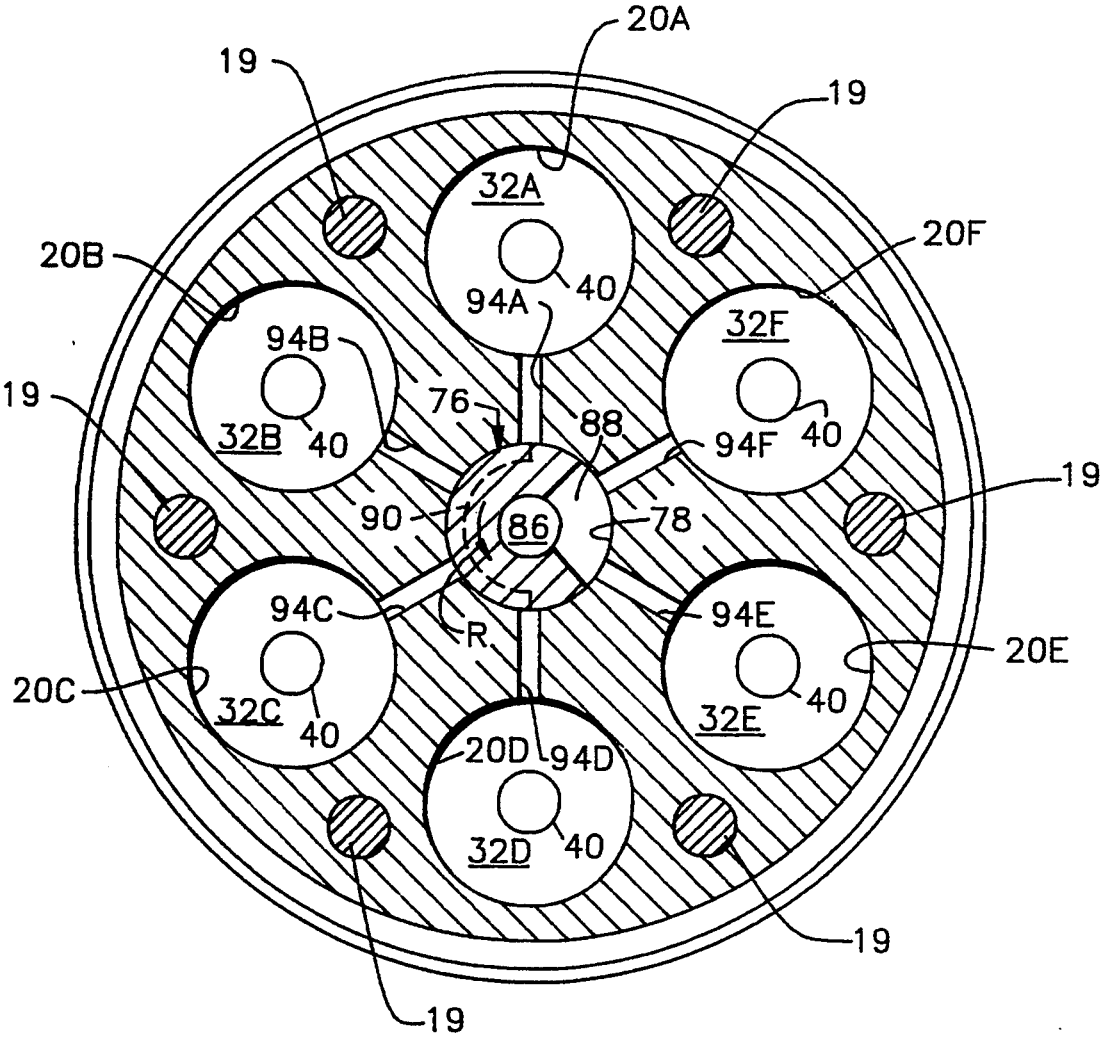
FIG. 2 is a cross-sectional view taken along a line II—II of FIG. 1.

FIG. 1 shows a swash-plate-type compressor as an axial multi-piston compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end faces thereof through the intermediary of O-ring rings 16 and 18, respectively. The cylinder block 10 and the housings 12 and 14 are assembled as an integrated unit by six screws 19 (see FIG. 2). In this embodiment, as shown in FIG. 2, the cylinder block 10 has six cylinder bores 20A, 20B, 20C, 20D, 20E, and 20F formed radially and circumferentially therein and spaced from each other at regular intervals, and each of the cylinder bores slidably receives a piston 22. The front housing 12 has a crank chamber 24 defined therewithin, and the rear housing 14 has a central suction chamber 26 and an annular discharge chamber 28 defined therewithin and partitioned by an annular wall portion 14a integrally projected from an inner wall of the rear housing 14. In this embodiment, the suction chamber 26 and the discharge chamber 28 are in communication with an evaporator and a condenser of the air-conditioning system, respectively, so that a fluid or refrigerant is supplied from the evaporator to the suction chamber 26 and a compressed refrigerant is delivered from the discharge chamber 28 to the condenser.

A valve plate assembly 30 is disposed between the rear end face of the cylinder block 10 and the rear housing 14, and defines compression chambers 32A, 32B, 32C, 32D, 32E, and 32F together with the heads of the pistons 22 slidably received in the cylinder bores 20A to 20F, as shown in FIG. 2. The valve plate assembly 30 includes a disc-like plate member 34, a reed valve sheet 36 applied to an outer side surface of the disc-like plate member 34, and a retainer plate member 38 applied to an outer side surface of the reed valve sheet 36. The disc-like member 34 may be made of a suitable metal material such as steel, and has six discharge ports 40 formed radially and circumferentially therein and spaced from each other at regular intervals, so that each of the discharge ports 40 is encompassed within an end opening area of the corresponding one of the cylinder bores 20A to 20F. Note, in FIG. 2, each of the discharge ports 40 is illustrated by a phantom line. The reed valve sheet 36 may be made of spring steel, phosphor bronze, or the like, and has six discharge reed valve elements 42 formed integrally therewith and arranged radially and circumferentially to be in register with the discharge ports 40, respectively, whereby each of the discharge reed valve elements 42 can be moved so as to open and close the corresponding discharge port 40, due to a resilient property thereof. The retainer plate member 38 may be made of a suitable metal material such as steel, and is preferably coated with a thin rubber layer. The retainer plate member 38 has six retainer elements 44 formed integrally therewith and arranged radially and circumferentially to be in register with the discharge reed valve elements 42, respectively. Each of the retainer elements 44 provides a sloped bearing surface for the corresponding one of the discharge reed valve elements 42, so that each discharge reed valve element 42 is opened only by a given angle defined by the sloped bearing surface of the retainer element 44.

A drive shaft 46 extends within the front housing 12 so that a rotational axis thereof matches a longitudinal axis of the front housing 12, and one end of the drive shaft 46 is projected outside from an opening formed in a neck portion **12*a* of the front housing 10 and is operatively connected to a prime mover of the vehicle for rotation of the drive shaft 46. The drive shaft 46 is rotatably supported by a first radial bearing 48 provided in the opening of the neck portion 12*a* and by a second radial bearing 50 provided in a central passage formed in the cylinder block 10. A rotary seal unit 52 is provided in the opening of the neck portion 12*a* to seal the crank chamber 24** from the outside.

A drive plate member 54 is mounted on the drive shaft 46 so as to be rotated together therewith, and a thrust bearing 56 is disposed between the drive plate member 54 and an inner side wall portion of the front housing 12. Also, a sleeve member 58 is slidably mounted on the drive shaft 46, and has a pair of pin elements 60 projected diametrically therefrom. Note, in FIG. 1, only one pin element 60 is illustrated by a broken line. A swash plate member 62 is swingably supported by the pair of pin elements 60. As apparent from FIG. 1, the swash plate member 62 is in an annular form, and the drive shaft 46 extends through a central opening of the annular swash plate member 62. The drive plate member 54 is provided with an extension 54*a* having an elongated guide slot 54b formed therein, and the swash plate member 62 is provided with a bracket portion 62*a* projected integrally therefrom and having a guide pin element 62*b* received in the guide slot 54*b*, whereby the swash plate member 62 can be rotated together with the drive plate member 54, and is swingable about the pair of pin elements 60. A wobble plate member 64 is slidably mounted on an annular portion 66 projected integrally from the swash plate member 62, and a thrust bearing 68 is disposed between the swash plate member 62 and the wobble plate member 64.

The sleeve member 58 is always resiliently pressed against the drive plate member 54 by a compressed coil spring 70 mounted on the drive shaft 46 and constrained between the sleeve member 58 and a ring element 72 securely fixed on the drive shaft 46, and thus the sleeve member 58 is resiliently biased against the drive plate member 54.

To reciprocate the pistons 22 in the cylinder bores 20A to 20F, respectively, the wobble plate member 64 is operatively connected to the pistons 22 through the intermediary of six connecting rod 74 having spherical shoe elements 74a and 74b formed at ends thereof, and the spherical shoe elements 74*a* and 74*b* of each connecting rod 74 are slidably received in spherical recesses formed in the wobble plate member 64 and the corresponding piston 22, respectively. With this arrangement, when the swash plate member 62 is rotated by the drive shaft 46, the wobble plate member 64 is swung about the pair of pin elements 60, so that each of the pistons 22 are reciprocated in the corresponding cylinder bore 20A, 20B, 20C, 20D, 20E, 20F. The crank chamber 24 can be in communication with the suction chamber 26 and/or the discharge chamber through a suitable control valve (not shown) so that a pressure within the crank chamber 24 is variable, whereby the stroke length of the pistons 22 is adjustable.

As shown in FIGS. 1 and 2, according to the present invention, a rotary valve 76 is slidably disposed in a circular space 78 defined by a part of the central passage of the cylinder block 10. The rotary valve 76 is coupled to the inner end of the drive shaft 46 so as to be rotated together therewith. To this end, as shown in FIG. 1, the rotary valve 76 is provided with a central hole 80 formed in one end face thereof and having a key slot 80*a* extending radially therefrom, and the drive shaft 46 is provided with a stub element 82 projected from the inner end face thereof and having a key 82*a* extending radially therefrom. Namely, the stub element 82 having the key 82*a* is inserted into the central hole 80 having the key slot 80*a*, so that the rotary valve 76 can be rotated together with the drive shaft 46. Note, in FIG. 1, a reference numeral 84 indicates a thrust bearing for the rotary valve 76, which is disposed in a central recess formed in the annular wall portion 14*a* of the rear housing 14.

The rotary valve 76 is also provided with a central hole 86 formed therein, and the central hole 86 is opened at the other end face of the rotary valve 76 so as to be in communication with the suction chamber 26 through a central passage of the thrust bearing 84. As best shown in FIG. 2, a suction passage or sector-shaped groove 88 is formed in the rotary valve 76, and is in communication with the central hole 86. Thus, the sector-shaped groove 88 is in communication with the suction chamber 26 through the central hole 86. The rotary valve 76 is further provided with a groove passage 90 formed in a cylindrical peripheral surface thereof and diametrically opposed to the sector-shaped groove 88, as shown in FIG. 2. As is apparent from FIG. 3 in which an outer peripheral wall surface of the rotary valve 76 is shown as a development view, the groove passage 90 includes a groove section 90*a* extended along a generatrix line of the cylindrical surface of the rotary valve 76; two arcuate sections 90*b* and 90*c* somewhat converged and extended from the ends of the section 90*a* circumferentially along the cylindrical surface of the rotary valve 76; sections 90*d* and 90*e* inwardly bent from the converged ends of the arcuate sections 90*b* and 90*c*; and parallel arcuate sections 90*f* and 90*g* extended from the inner ends of the bent sections 90*d* and 90*e*.

Figure 3:
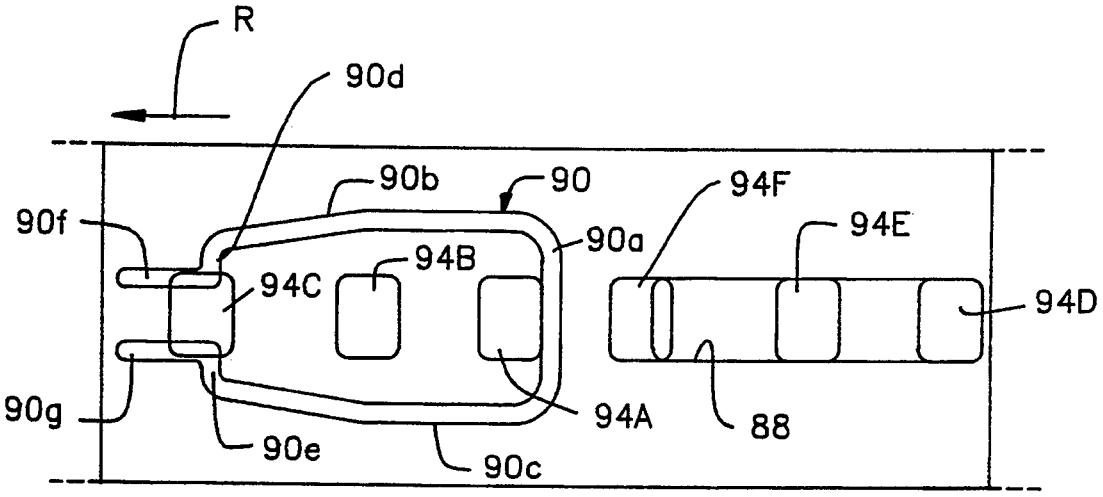
FIG. 3 is a development view showing an outer wall surface of a suction rotary valve and an inner wall surface of a central space formed in a cylinder block of the compressor and slidably receiving the suction rotary valve.

As best shown in FIG. 2, the cylinder block 10 is provided with six radial passages 94A, 94B, 94C, 94D. 94E, and 94F formed therein and extended from the compression chambers 32A to 32F to the circular space 78 of the cylinder block 10, respectively. In FIG. 3, an inner peripheral wall surface of the circular space 78 is also shown in a development view to illustrate a relationship between the rotary valve 76 and the arrangement of the radial passages 94A, 94B, 94C, 94D, 94E, and 94F. As is apparent from FIG. 3, the distance between the parallel arcuate sections 90*b* and 90*c* is substantially equal to a longitudinal width of the openings of the radial passages 94A, 94B, 94C, 94D, 94E, and 94F, and each of the sections 90*b* and 90*c* has a length substantially equal to a distance between the openings of the two adjacent ones of the radial passages 94A, 94B, 94C, 94D, 94E, and 94F.

When the rotary valve 76 is rotated by the drive shaft 46 in a direction indicated by an arrow R (FIGS. 2 and 3), the radial passages 94A to 94F successively communicate with the suction chamber 26 through the central hole 86 and the sector-shaped groove 88. Also, during the rotation of the drive shaft 46, the pistons 22 are reciprocated in the cylinder bores 20A to 20F, so that a suction stroke and a compression stroke are alternately executed in each of the cylinder bores 20A to 20F. During the suction stroke, i.e., during movement of the piston 22 concerned from top dead center toward bottom dead center, the refrigerant is introduced from the suction chamber 26 into the corresponding compression chamber 32A, 32B, 32C, 32D, 32E, 32F through the central hole 86, the sector-shaped groove 88, and the corresponding radial passage 94A, 94B, 94C, 94D, 94E, 94F. During the compression stroke, i.e., during a movement of the piston 22 concerned from bottom dead center toward top dead center, the refrigerant is compressed in the corresponding compression chamber 32A, 32B, 32C, 32D, 32E, 32F, and is then discharged therefrom into the discharge chamber 28 through the corresponding reed valve 42.

For example, when the piston 22 received in the cylinder bore 20A reaches top dead center, the rotary valve 76 is at an angular position, as shown in FIG. 3, with respect to the six radial passages 94A, 94B, 94C, 94D, 94E, and 94F. At this point of time, in the cylinder bore 20A of compression chamber 32A, the compression stroke is just finished so that a part of the compressed refrigerant is inevitably left in a small volume of the compression chamber 32A defined by the piston head (22) and the valve plate assembly 30. On the other hand, in the diametrically opposed cylinder bore 20D or compression chamber 32D, the piston 22 reaches bottom dead center, and thus the suction stroke is just finished. Also, each of the cylinder bores 20B and 20C or compression chambers 32B and 32C is subjected to the compression stroke, and each of the cylinder bores 20E and 20F or compression chambers 32E and 32F is subjected to the suction stroke. Further, in the situation shown in FIG. 3, the side section 90*a* of the groove passage 90 bounds on the opening of the radial passage 94A, and the parallel arcuate sections 90*f* and 90*g* of the groove passage 90 partially lies over the opening of the radial passage 94C so that the compression chamber 32C communicates with the groove passage 90.

Figure 4:
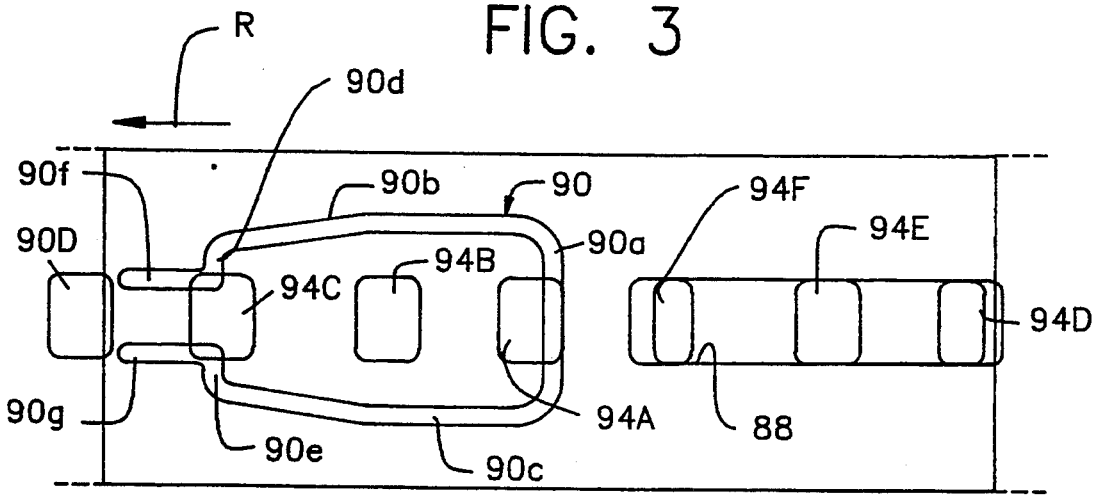
FIG. 4 is a development view similar to FIG. 3, in which the suction rotary valve is rotated from an angular position of FIG. 3.

As soon as the rotary valve 76 is rotated from the angular position shown in FIG. 3 to an angular position as shown in FIG. 4, the section 90*a* of the groove passage 90 comes over the opening of the radial passages 94A so that the groove passage 90 communicates with the compression chamber 32A. On the other hand, the communication is still maintained between the groove passage 90 and the compression chamber 32C. Accordingly, the compression chambers 32A and 32C communicate with each other through the groove passage 90, so that a part of the compressed residual refrigerant escapes from the compression chamber 32A into the compression chamber 32C. In the situation shown in FIG. 4, since the compression chamber 32C is still subjected to the compression stroke, the pressure of the escaped part of the refrigerant cannot be considerably lowered, so that the escaped part of the refrigerant can be efficiently re-compressed in the compression chamber 32C.

Figure 5:
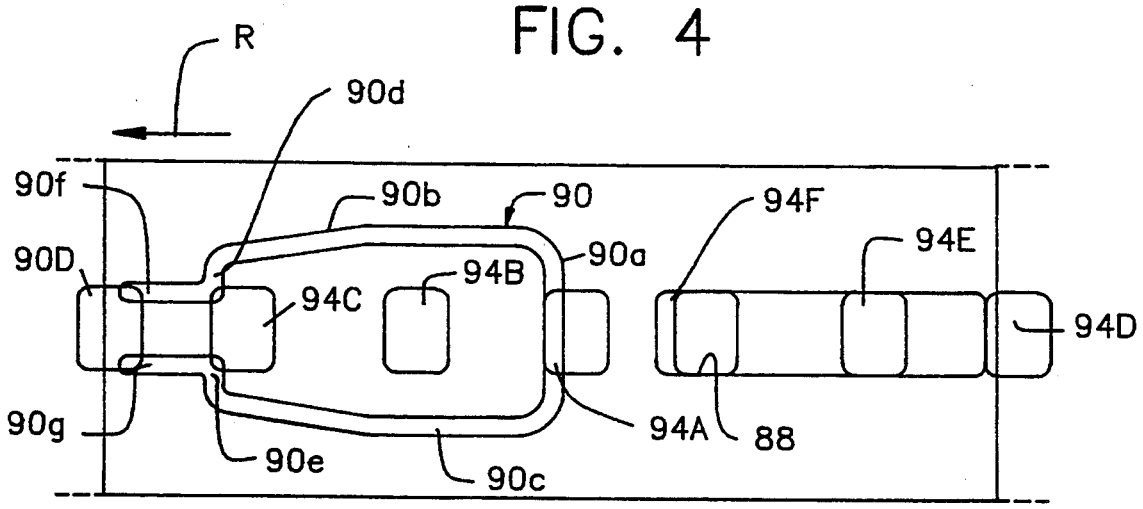
FIG. 5 is a development view similar to FIG. 3, in which the suction rotary valve is further rotated from an angular position of FIG. 4.

When the rotary valve 76 is further rotated from the angular position shown in FIG. 4 to an angular position as shown in FIG. 5, the communication is still maintained between the radial passage 94A and the groove passage 90, but the communication is cut off between the radial passage 94C and the groove passage 90, so that the compression chamber 32A is not in communication with the compression chamber 32C. Nevertheless, just after the communication is cut off between the radial passage 94C and the groove passage 90, the radial passage 94D communicates with the groove passage 90, because each of the sections 90*b* and 90*c* has the length substantially equal to the distance between the openings of the two adjacent ones of the radial passages 94A, 94B, 94C, 94D, 94E, and 94F, as mentioned above. Accordingly, the compression chamber 32A is then communicated with the compression chamber 32D just subjected to a compression stroke, as is apparent from FIG. 5, so that another part of the compressed residual refrigerant can escape from the compression chamber 32A into the compression chamber 32D. Thus, although the compressor is run at a higher speed, i.e., although the rotary valve 76 is rotated at a higher rotational speed, a sufficient amount of the residual refrigerant can escape from the compression chamber 32A, whereby the practical suction volume of the refrigerant in the compression chamber 32A during the suction stroke, can be made close to the theoretical suction volume of the refrigerant even during high speed running of the compressor.

After the section 90*a* of the groove passage 90 passes through the opening of the radial passage 94A, the sector-shaped groove 88 communicates with the radial passage 94A, and thus the refrigerant can be immediately introduced from the suction chamber 26 into the compression chamber 32A due to the escape of the residual refrigerant therefrom.

Figure 6:
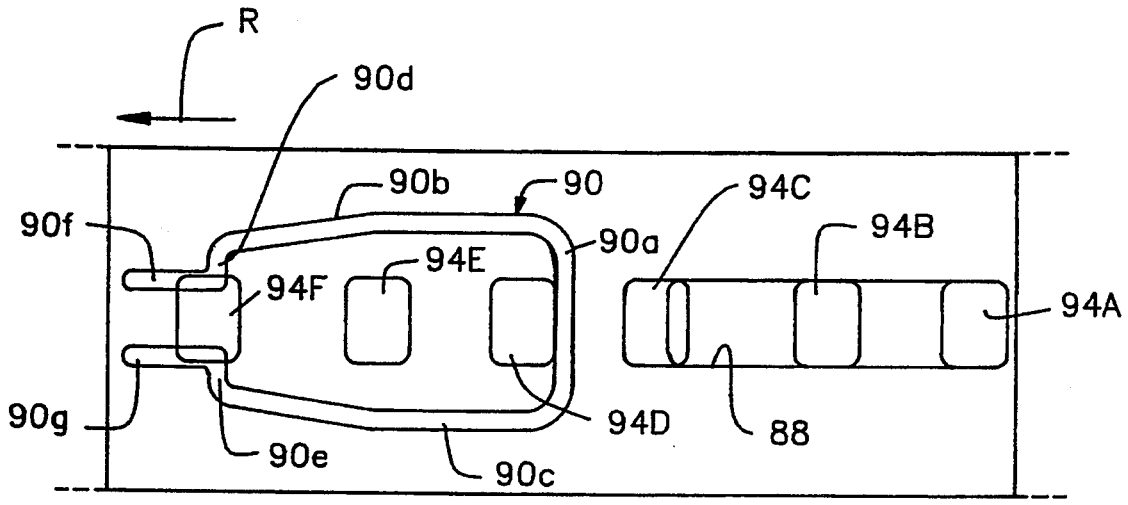
FIG. 6 is a development view similar to FIG. 3, in which the suction rotary valve is rotated over an angle of 180 degrees measured from the angular position of FIG. 3.

When the rotary valve 76 is rotated over an angle of 180 degrees measured from the angular position of FIG. 3, the rotary valve 76 is at an angular position as shown in FIG. 6, and this situation is equivalent to that of FIG. 3. Namely, in the cylinder bore 20D or compression chamber 32D in which the piston 22 reaches top dead center, the compression stroke is just finished, and in the cylinder bore 20A or compression chamber 32A in which the piston 22 reaches bottom dead center, the suction stroke is just finished. As soon as the rotary valve 76 is further rotated from the angular position of FIG. 6, a part of the residual refrigerant escapes from the compression chamber 32D to the compression chamber 32E, and another part of the residual refrigerant escapes from the compression chamber 32D to the compression chamber 32A, as is apparent from the descriptions referring to FIGS. 4 and 5.

Figure 7:
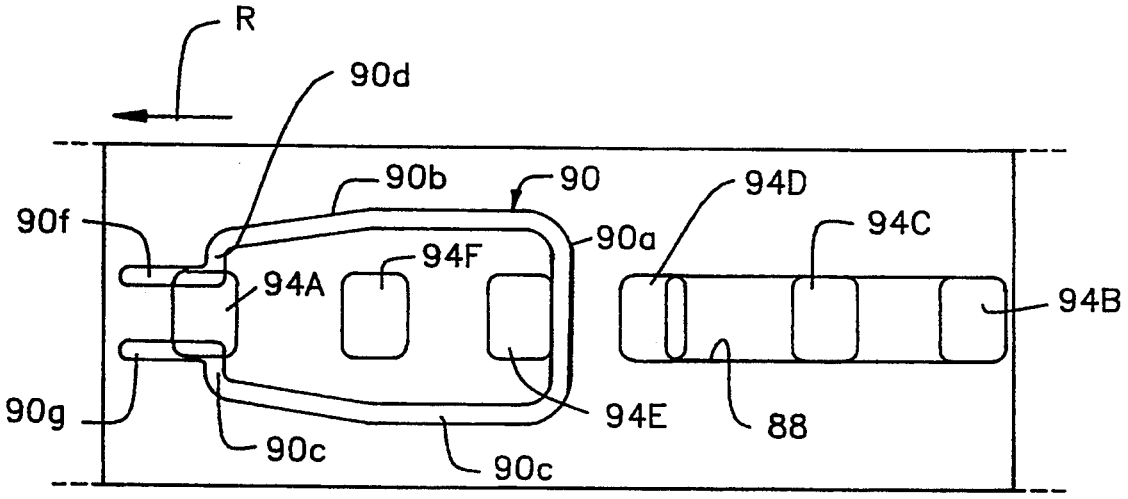
FIG. 7 is a development view similar to FIG. 3, in which the suction rotary valve is rotated over an angle of 60 degrees measured from the angular position of FIG. 6.

When the rotary valve 76 is rotated over an angle of 60 degrees measured from the angular position of FIG. 6, the rotary valve 76 is at an angular position as shown in FIG. 7, and this situation is also equivalent to that of FIG. 3. As soon as the rotary valve 76 is further rotated from the angular position shown in FIG. 7, the compression chamber 32A is supplied with a part of refrigerant that escaped from the compression chamber 32E.

As is apparent from FIGS. 3 to 7, the groove passage 90 is arranged to surround the openings of the radial grooves of the compression chambers subjected to the compression stroke, and this arrangement is significant, because a leakage of the refrigerant, which is caused at the openings of the radial passages and prevails in a clearance between the outer surface of the rotary valve 76 and the inner surface of the circular space 78, can be recovered by the groove passage 90.

Figure 8:
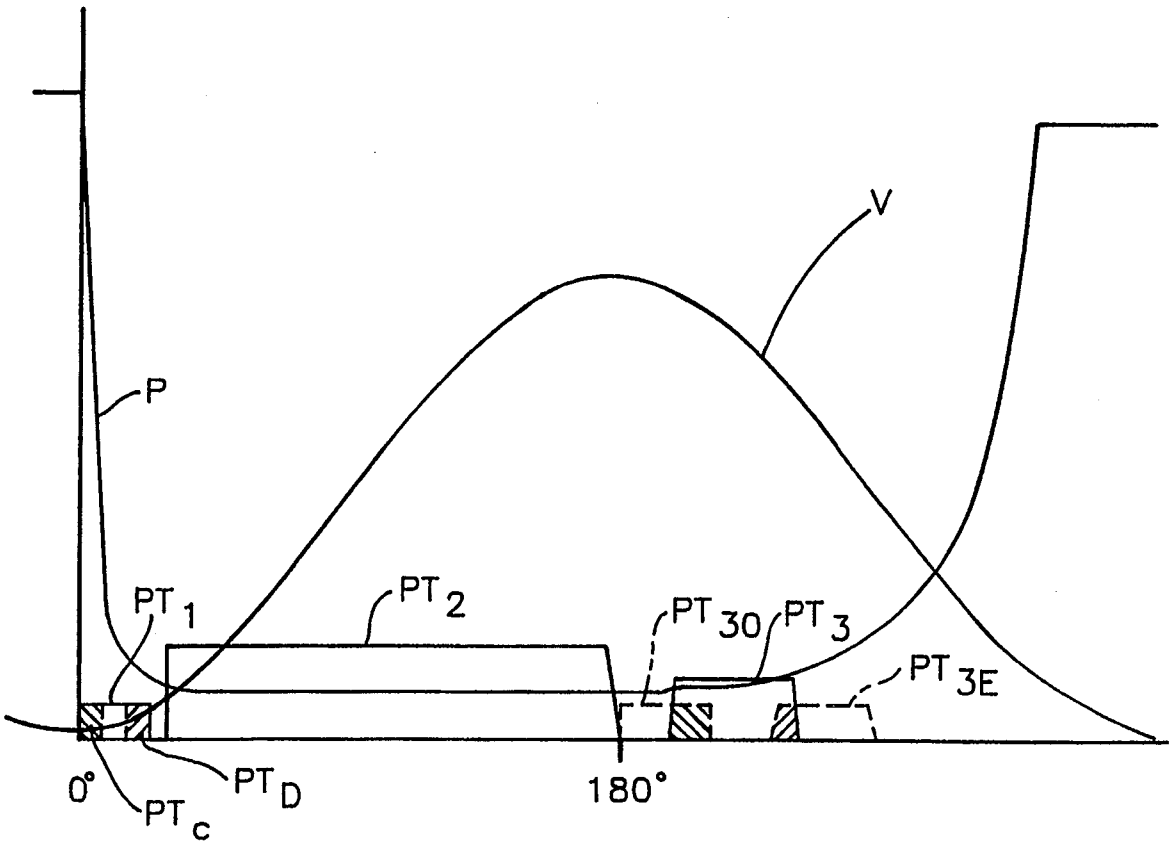
FIG. 8 is a graph showing a variation of pressure in a compression chamber and a variation of volume thereof when rotating the suction rotary valve over an angle of 360 degrees.

FIG. 8 is a graph showing a variation in pressure in the compression chamber 32A, represented by a curve P, and a variation in volume of the compression chamber 32A, represented by a curve V, when rotating the rotary valve 76 over an angle of 360 degrees. In this graph, it is assumed that a rotational angle of the rotary valve 76 is zero when the piston 22 is at top dead center in the cylinder bore 20A (FIG. 3).

As soon as the rotary valve 76 is rotated from the angular position shown in FIG. 3, the section 90*a* of the groove passage 90 comes over the opening of the radial passage 94A (FIG. 4), so that the communication is established between the compression chamber 32A and the compression chamber 32C through the radial passages 94A and 94C and the groove passage 90. In the graph of FIG. 8, reference $PT_1$ indicates a period of time over which the section 90*a* of the groove passage 90 passes the opening of the radial passage 94A. Namely, the communication is maintained between the compression chamber 32A and the groove passage 90 over the period of time $PT_1$. In a hatched area $PT_C$ of the period $PT_1$, the compression chambers 32A and 32C communicate with each other (FIG. 4) through the groove passage 90, and thus a part of residual refrigerant is fed from the compression chamber 32A to the compression chamber 32C, so that the pressure P of the compression chamber 32A is rapidly lowered. In a hatched area $PT_D$ of the period $PT_1$, the compression chambers 32A and 32D communicate with each other (FIG. 5) through the groove passage 90, so that an additional part of the residual refrigerant is fed from the compression chamber 32A to the compression chamber 32D, so that the pressure P of the compression chamber 32A is further lowered.

After the section 90*a* of the groove passage 90 passes the opening of the radial passage 94A, the compression chamber 32A communicates with the suction chamber 26 through the central hole 86, the sector-shaped groove 88 and the radial passage 94A. In the graph of FIG. 8, reference $PT_2$ indicates the period of time over which the communication is maintained between the compression chamber 32A and the suction chamber 26, and the suction stroke is executed over the period of time $PT_2$. During the suction stroke, the pressure P is kept constant, and the volume V of the compression chamber 32A reaches a maximum peak at the end of the suction stroke. After the suction stroke is finished, i.e., after the compression stroke is initiated, the pressure is gradually increased.

In the graph of FIG. 8, reference $PT_3$ indicates the period of time over which the parallel arcuate sections 90*f* and 90*g* pass the opening of the radial passage 94A. Namely, communication is maintained between the compression chamber 32A and the groove passage 90 over the period of time $PT_3$. Also, reference $PT_{3\,D}$ indicates the period of time when the section 90*a* of the groove passage 90 passes the opening of the radial passage 94D, and reference $PT_{3\,E}$ indicates the period of time when the section 90*a* of the groove passage 90 passes the opening of the radial passage 94E. Namely, the communication is maintained between the compression chamber 32D and the groove passage 90 during the period of time $PT_{3\,D}$, and the communication is maintained between the compression chamber 32E and the groove passage 90 during the period of time $PT_{3\,E}$. In a hatched area at which the periods $PT_3$ and $PT_{2\,D}$ overlap each other, communication is established between the compression chambers 32A and 32D through the groove passage 90, so that the compression chamber 32A is supplied with a part of refrigerant that escaped from the compression chamber 32D, and thus the pressure P is somewhat and abruptly raised at the hatched area. Also, in a hatched area at which the periods $PT_3$ and $PT_{3\,E}$ overlap each other, communication is established between the compression chambers 32A and 32E through the groove passage 90, so that the compression chamber 32A is supplied with a part of refrigerant that escaped from the compression chamber 32E, and thus the pressure P is somewhat and abruptly raised at the hatched area.

Thereafter, the pressure P is rapidly increased in response to a decrease of the volume V of the compression chamber 32A, shown in the graph of FIG. 8. When the pressure P reaches the maximum value, the corresponding discharge reed valve 42 is opened so that the compressed refrigerant is discharged from the compression chamber 32A into the discharge chamber 28, and thus the maximum value of the pressure P is kept constant.

Note, although only the cylinder bore 20A or compression chamber 32A has been referred to in the above-description, the same is true for other compression chambers 32B, 32C, 32D, 32E, 32F.

Figure 9:
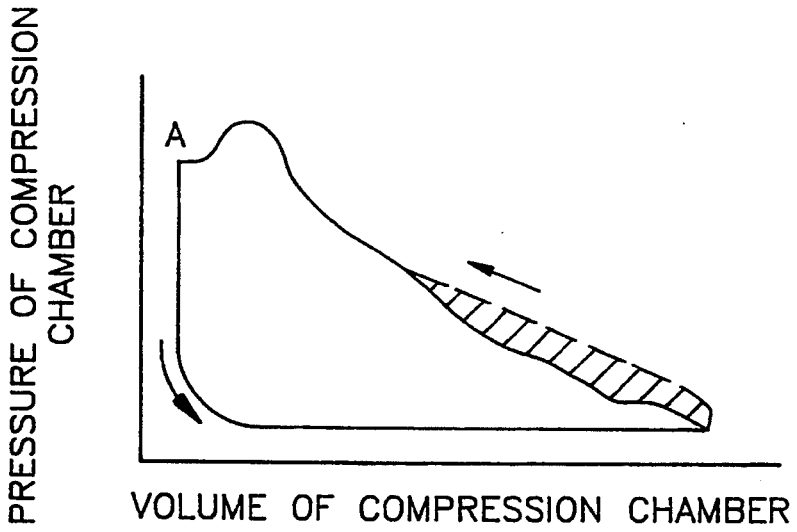
FIG. 9 is a graph showing an operation cycle performed in each compression chamber of the compressor.

FIG. 9 shows an operation cycle performed in each of the compression chambers 32A, 32B, 32C, 32D, 32E, and 32F. In this cycle, references A and B indicate top dead center and bottom dead center. The suction stroke is executed in a section indicated by A→B, and the compression stroke is executed in a section indicated by B→A. In the compressor disclosed in U.S. Pat. No. 5,232,349, the compression stroke is executed along a broken line shown in FIG. 9. The efficiency of the compressor according to the present invention is improved by a differential indicated by a hatched area in FIG. 9.

In the embodiment described, although the present invention is applied to a variable capacity swash-plate type compressor as an axial multi-piston compressor, the present invention may be embodied in another type axial multi-piston compressor.

Finally, it will be understood by those skilled in the art that the foregoing description is of a preferred embodiment of the disclosed compressor, and that various changes and modifications may be made to the present invention without departing from the spirit and scope thereof.

We claim:

1. An axial multi-piston compressor comprising:

a drive shaft;

a cylinder block having cylinder bores formed therein and surrounding said drive shaft;

a plurality of pistons slidably received in the respective cylinder bores;

a conversion means for converting a rotational movement of said drive shaft into a reciprocation of each piston in the corresponding cylinder bore such that a suction stroke and a discharge stroke are alternately executed therein, during the suction stroke, a fluid being introduced into the cylinder bore concerned, and during the compression stroke, the introduced fluid being compressed and discharged from the cylinder bore concerned, such that a residual part of the compressed fluid is inevitably left in the cylinder bore concerned when the compression stroke is finished; and a valve means for allowing the residual fluid to escape from the cylinder bore concerned into two other cylinder bores disposed adjacent to each other and subjected to the compression stroke, whereby a practical suction volume of the fluid in the cylinder bore concerned, can be made close to a theoretical suction volume even during high speed running of the compressor.

2. An axial multi-piston compressor as set forth in claim 1, wherein the residual fluid escapes from the cylinder bore concerned into the one of the two other cylinder bores which is subjected to a compression stroke prior to the other cylinder bore being subjected to a compression stroke.

3. An axial multi-piston compressor as set forth in claim 1, wherein said valve means comprises a rotary valve joined to said drive shaft to be rotated together therewith and having a groove passage formed in a peripheral surface thereof, and during the rotation of said rotary valve, a communication between the cylinder bore concerned and each of the two other cylinder bores is established by said groove passage, whereby the residual part of the compressed fluid can escape from the compressor concerned into each of the two other cylinder bores.

4. An axial multi-piston compressor as set forth in claim 3, wherein said rotary valve is slidably disposed in a circular space defined by a part of a central passage formed in said cylinder block, and the cylinder block has radial passages formed therein and extended from said cylinder bores to the circular space of said cylinder block, respectively; the communication between the cylinder bore concerned and each of the two other cylinder bores is established by said groove passage and the radial passages thereof during the rotation of the rotary valve in the circular space of said cylinder block.

5. An axial multi-piston compressor as set forth in claim 4, wherein said rotary valve includes a suction passage formed therein to introduce the fluid into each of the cylinder bores during the suction stroke.

6. An axial multi-piston compressor as set forth in claim 5, wherein said groove passage and said suction passage are diametrically opposed to each other on the peripheral surface of said rotary valve.

7. An axial multi-piston compressor as set forth in claim 6, wherein said groove passage is arranged so as to surround the openings of the radial passages of the compression chambers subjected to the compression stroke.

* * * * *